US008096089B2

(12) United States Patent
Platt

(10) Patent No.: US 8,096,089 B2
(45) Date of Patent: Jan. 17, 2012

(54) SUSPENDED CEILING CLOUD WITH FLEXIBLE PANEL

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 544 days.

(21) Appl. No.: 12/151,533

(22) Filed: May 6, 2008

(65) Prior Publication Data

US 2009/0277117 A1 Nov. 12, 2009

(51) Int. Cl.
*E04B 9/00* (2006.01)
*E04B 9/26* (2006.01)

(52) U.S. Cl. ..... 52/316; 52/506.07; 52/506.09; 52/511

(58) Field of Classification Search ..... 52/506.05, 52/506.07, 506.08, 506.09, 510, 511, 489.1, 52/316, 506.01, 506.06, 507, 508; D25/61, D25/119, 120, 121, 122, 123, 124, 125, 138; 248/317, 342, 343; *E04B 9/00, 9/04, 9/06, E04B 9/10, 9/22, 9/24, 9/26*
See application file for complete search history.

(56) References Cited

U.S. PATENT DOCUMENTS

| | | | | | |
|---|---|---|---|---|---|
| 1,854,438 | A | * | 4/1932 | Wray | 52/506.09 |
| 2,736,528 | A | * | 2/1956 | Le Brock | 248/317 |
| 3,201,077 | A | * | 8/1965 | Heimann | 452/187 |
| 3,387,418 | A | * | 6/1968 | Tyrer | 52/242 |
| 3,436,047 | A | * | 4/1969 | Foltz | 248/317 |
| 3,459,399 | A | * | 8/1969 | Everson | 248/343 |
| 3,480,245 | A | * | 11/1969 | Gingher | 248/317 |
| 3,558,091 | A | * | 1/1971 | Bush | 248/317 |
| 3,605,368 | A | * | 9/1971 | Lalouche | 52/460 |
| 3,710,530 | A | * | 1/1973 | Valtonen | 52/666 |
| 4,091,588 | A | * | 5/1978 | Heirich | 52/478 |
| 4,115,484 | A | * | 9/1978 | Saxton | 261/111 |
| 4,189,888 | A | * | 2/1980 | Blitzer, Jr. | 52/506.07 |
| 4,206,578 | A | * | 6/1980 | Mieyal | 52/506.07 |
| 4,245,442 | A | * | 1/1981 | Durham | 52/126.4 |
| 4,444,524 | A | * | 4/1984 | Cook et al. | 403/387 |
| 4,463,537 | A | * | 8/1984 | Rodriquez et al. | 52/506.07 |
| 4,471,596 | A | * | 9/1984 | Deaton et al. | 52/668 |
| 4,490,957 | A | * | 1/1985 | Bumpus et al. | 52/506.07 |
| 4,543,755 | A | * | 10/1985 | Crandell | 52/235 |
| 4,633,631 | A | * | 1/1987 | Crandell | 52/235 |
| 4,744,188 | A | | 5/1988 | Ahren | |
| 4,747,246 | A | * | 5/1988 | Sanborn | 52/506.07 |
| 4,848,054 | A | * | 7/1989 | Blitzer et al. | 52/506.07 |
| 4,922,677 | A | * | 5/1990 | Fridh et al. | 52/506.07 |
| 5,226,720 | A | * | 7/1993 | Caferro | 362/150 |
| 5,263,292 | A | * | 11/1993 | Holland et al. | 52/235 |
| 5,419,606 | A | * | 5/1995 | Hull et al. | 296/146.7 |

(Continued)

FOREIGN PATENT DOCUMENTS

DE 3734743 A1 * 4/1989

(Continued)

*Primary Examiner* — Brian Glessner
*Assistant Examiner* — Joseph J Sadlon
(74) *Attorney, Agent, or Firm* — Eugene Chovanes

(57) ABSTRACT

In a suspended ceiling segment known as a cloud, lengths of flat, flexible sheets form panels that are held on the main beams of the segment by flexible, plastic tracks adhesively fixed on the panels that engage plastic tracks hooked onto flanges of the main beams of the cloud. The flexible sheets bend to conform to the vertical contour of the main beams when the tracks on the sheets engage the tracks on the beams.

5 Claims, 5 Drawing Sheets

U.S. PATENT DOCUMENTS

| | | | | | |
|---|---|---|---|---|---|
| 5,507,125 | A * | 4/1996 | McClure | 52/506.07 |
| 5,611,184 | A * | 3/1997 | Felix et al. | 52/506.05 |
| 5,611,185 | A * | 3/1997 | Wilz | 52/506.07 |
| 5,644,878 | A * | 7/1997 | Wehrmann | 52/287.1 |
| 5,692,346 | A * | 12/1997 | Irvine et al. | 52/506.09 |
| 5,845,447 | A * | 12/1998 | Bodine et al. | 52/506.09 |
| 6,047,512 | A * | 4/2000 | Wendt et al. | 52/506.07 |
| 6,050,534 | A * | 4/2000 | Andrews | 248/317 |
| 6,101,777 | A * | 8/2000 | Bodine et al. | 52/506.06 |
| 6,145,264 | A * | 11/2000 | Dallaire | 52/506.07 |
| 6,374,564 | B1 | 4/2002 | Fletterick et al. | |
| 6,574,936 | B1 * | 6/2003 | Anderson, Sr. | 52/506.06 |
| 6,701,686 | B1 * | 3/2004 | Platt | 52/506.07 |
| 6,834,467 | B2 * | 12/2004 | Gulbrandsen et al. | 52/506.07 |
| 6,968,661 | B2 * | 11/2005 | Kopish et al. | 52/489.1 |
| 7,562,504 | B2 * | 7/2009 | Herbst et al. | 52/461 |
| 2002/0124514 | A1 * | 9/2002 | Higgins | 52/506.06 |
| 2002/0152704 | A1 * | 10/2002 | Thompson et al. | 52/506.06 |
| 2003/0154679 | A1 * | 8/2003 | Swiszcz et al. | 52/506.07 |
| 2005/0257476 | A1 * | 11/2005 | Saidoo et al. | 52/506.07 |
| 2006/0016145 | A1 * | 1/2006 | Lonneman | 52/506.06 |
| 2006/0101764 | A1 * | 5/2006 | Jankovec et al. | 52/506.07 |
| 2006/0179765 | A1 * | 8/2006 | Howard et al. | 52/506.07 |
| 2008/0148667 | A1 * | 6/2008 | Payne | 52/506.07 |

FOREIGN PATENT DOCUMENTS

| | | | |
|---|---|---|---|
| DE | 19705252 | C1 * | 5/1998 |
| GB | 2160240 | A * | 12/1985 |
| GB | 2407826 | A * | 5/2005 |
| JP | 07324430 | A * | 12/1995 |
| JP | 2001200610 | A * | 7/2001 |
| WO | WO 0190586 | A2 * | 11/2001 |

* cited by examiner

FIG. 4
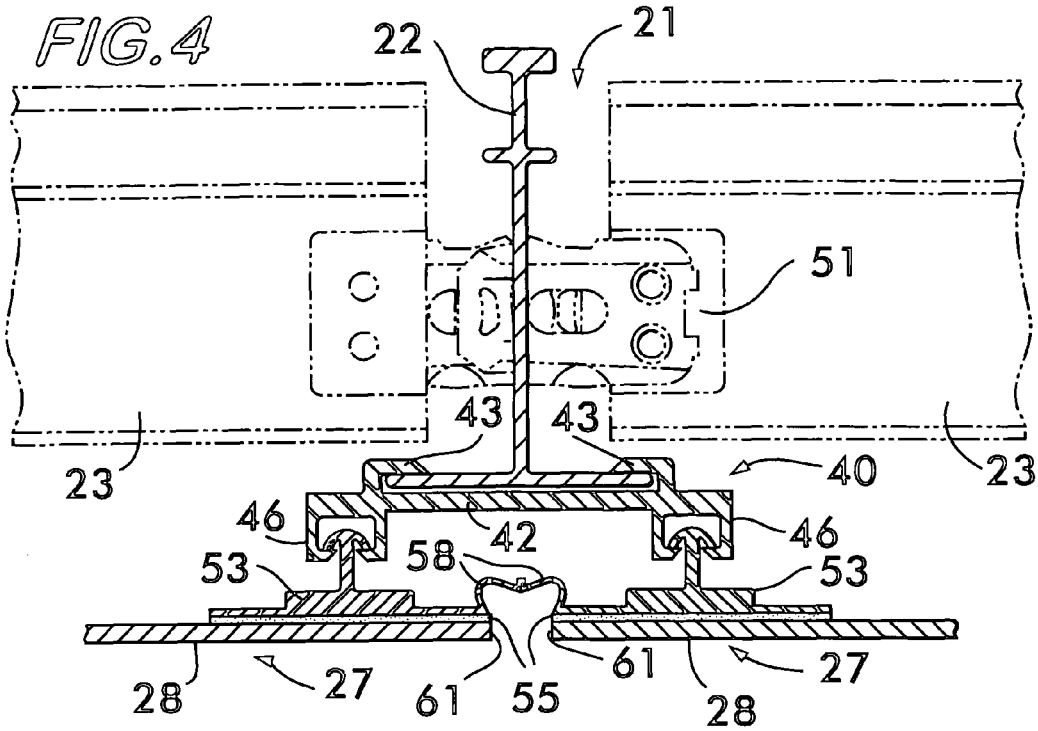
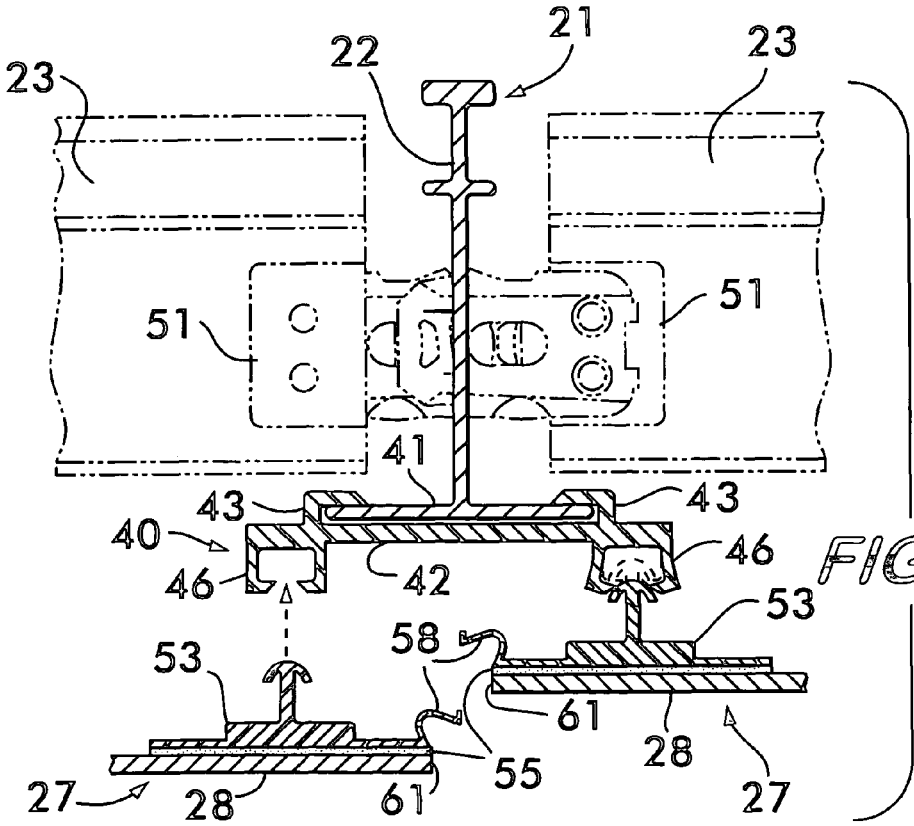
FIG. 5

FIG. 6
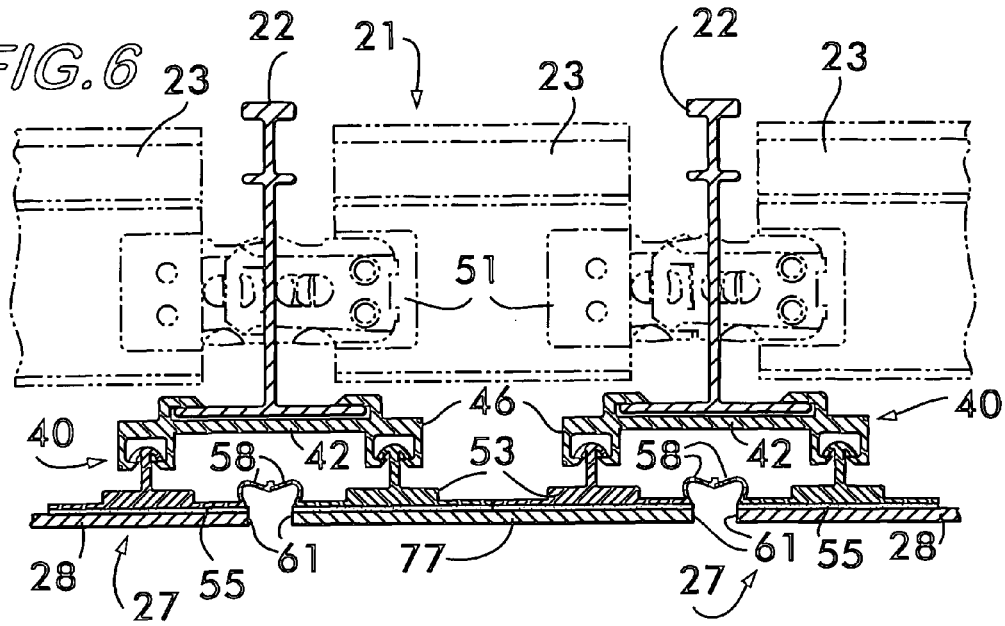
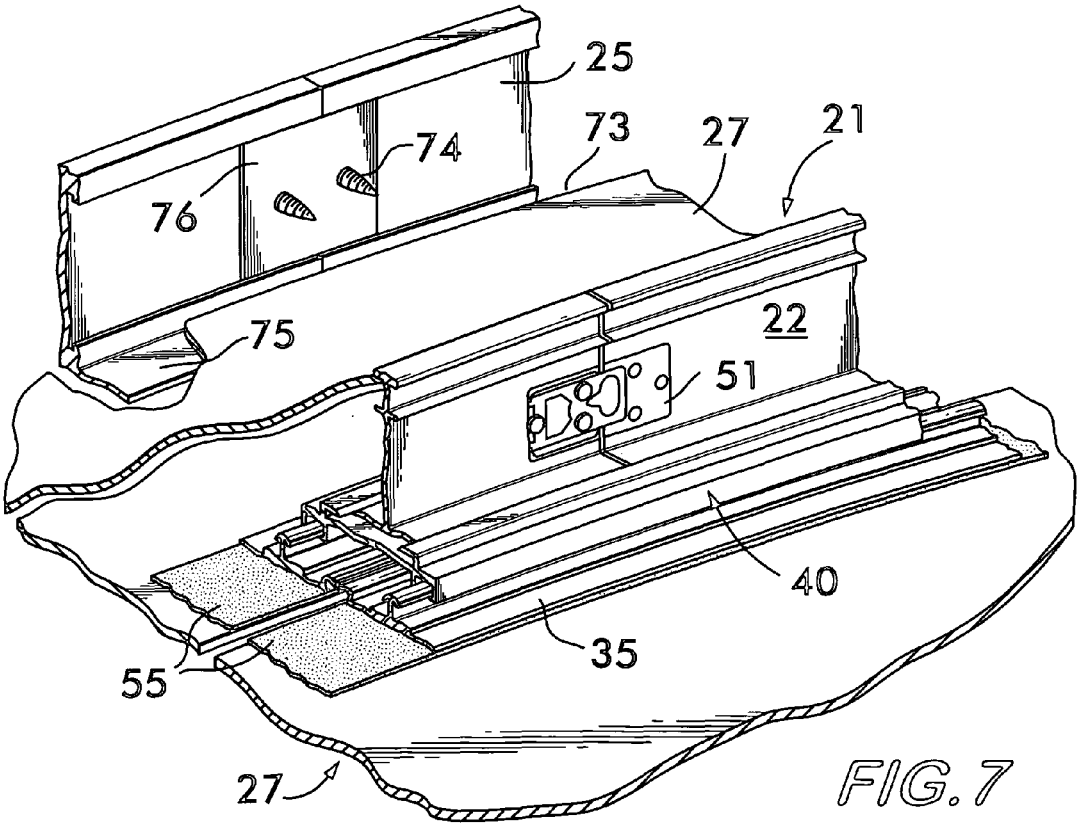
FIG. 7

SUSPENDED CEILING CLOUD WITH FLEXIBLE PANEL

BACKGROUND OF THE INVENTION (1) Field of the Invention The invention relates to a suspended ceiling having a gridwork of intersecting beams that support panels. Such a suspended ceiling hangs from a structural ceiling.

The invention particularly relates to a segment of a suspended ceiling that hangs by itself, away from side walls, below the structural ceiling, to produce a cloud, or island, effect.

(2) Description of the Related Art

Most suspended ceilings extend completely over a room. Such a suspended ceiling hangs from a structural ceiling, and extends horizontally in a flat plane. The suspended ceiling creates a space between the structural and suspended ceiling that generally contains building elements such as piping, wiring, and air ducts. The suspended ceiling generally has openings for lights and air ventilation. In such suspended ceilings, stiff, rectangular lay-in panels, are supported in grid openings formed by intersecting main and cross beams.

Occasionally, segments of such suspended ceilings, referred to as clouds, or islands, that do not extend completely over a room, are used primarily to produce an ornamental effect in an area.

Such a cloud may extend in a flat horizontal plane, but more generally the cloud has a curved contour in a vertical plane to create a three-dimensional structure. Such curved contours can simulate a wave, a vault, a valley, or a combination of such contours, as well as other vertical contours.

The grid in such clouds is formed with longitudinally extending parallel main beams, connected with cross beams. Preformed lay-in panels that conform to the cloud vertical contour, curved or flat, are set in openings in the grid of such a ceiling cloud, as seen for instance in U.S. Pat. No. 6,374,564.

A wide variety of preformed lay-in panels must be available to accommodate the wide variety of different vertical contours that exist in such clouds.

BRIEF SUMMARY OF THE INVENTION

Panels formed from lengths of flat, flexible sheets are inserted in the grid of a suspended ceiling cloud that has either a curved or flat vertical contour. Tracks that are fixed on a length of flat, flexible sheet, are inserted into tracks that are fixed on longitudinally extending parallel main beams of the grid.

The length of flexible sheet readily follows the contour of the longitudinally extending parallel main beams, whether flat or curved, as the tracks fixed on the flexible sheet are being inserted into the tracks fixed on the main beams, so there is no need to match a prior art rigid, preformed, generally curved, lay-in panel to the contour of the longitudinally extending parallel main beams.

The tracks fixed on the flexible sheet that forms the panel may be threaded into the tracks fixed on the longitudinally extending parallel main beams, or in the alternative, the tracks fixed on the panel may be snapped into the tracks fixed on the longitudinally extending parallel main beams.

The panels of the invention, in addition to providing a decorative surface on the suspended ceiling cloud, when in place, also serve to reinforce the grid of the cloud by providing a stiffening effect in the surface plane of the cloud, whether curved or flat.

BRIEF DESCRIPTION OF SEVERAL VIEWS OF THE DRAWINGS

FIG. 4 is a vertical cross sectional view of a main beam in the grid of a suspended ceiling cloud, with tracks fixed on a flexible ceiling panel of the invention engaging tracks fixed on a longitudinally extending main beam.

FIG. 5 is a view similar to FIG. 4 with the tracks fixed on a panel of the invention being snapped into the tracks fixed on a longitudinally extending main beam.

FIG. 6 is a view similar to FIGS. 4 and 5 wherein the tracks fixed on a series of panels are engaged in tracks fixed on each of a pair of longitudinally extending parallel main beams.

FIG. 7 is a perspective view, taken from above, showing a flexible panel at the perimeter of a suspended ceiling cloud of the invention supported on a ledge of a perimeter strip secured around the grid of a ceiling cloud, and with a track fixed on the panel engaged with a track fixed on a main beam.

DETAILED DESCRIPTION OF THE INVENTION

Figure 2:
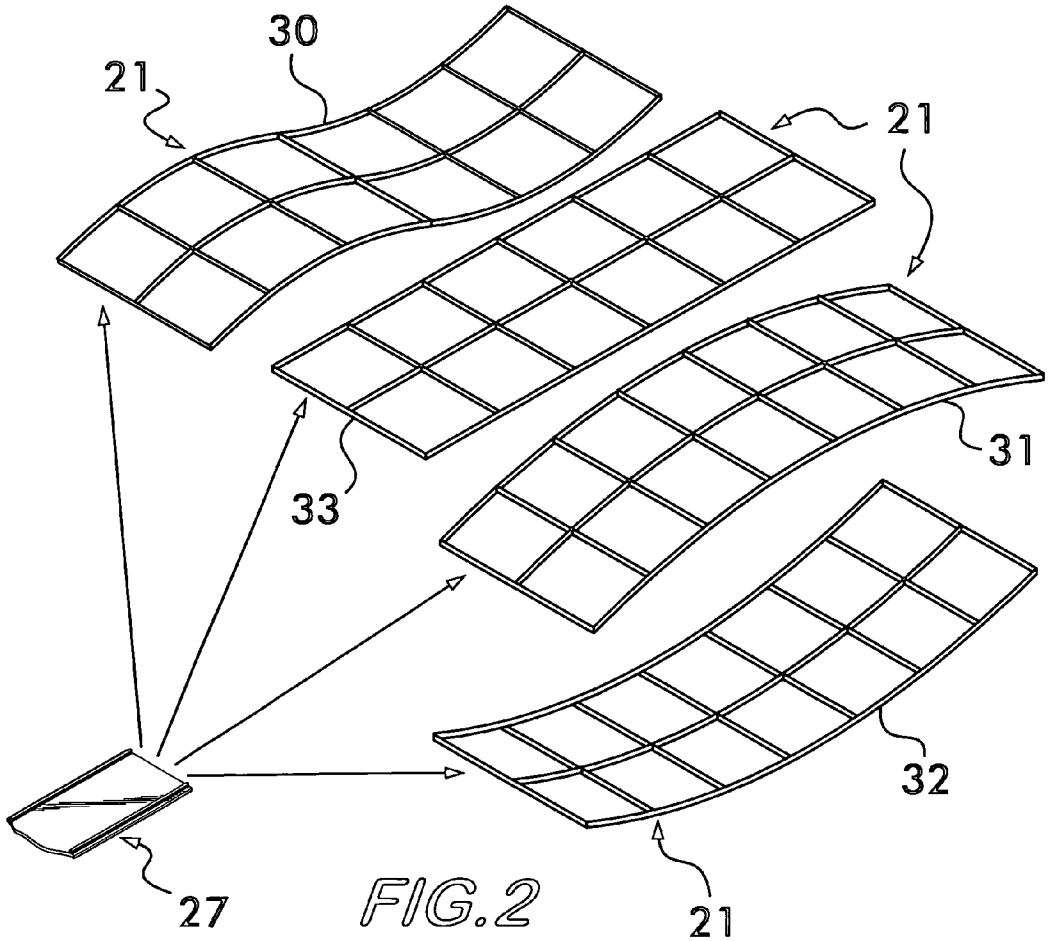
FIG. 2 is a schematic view of some shapes of suspended ceiling clouds capable of using the flexible ceiling panel of FIG. 1.
Figure 3:
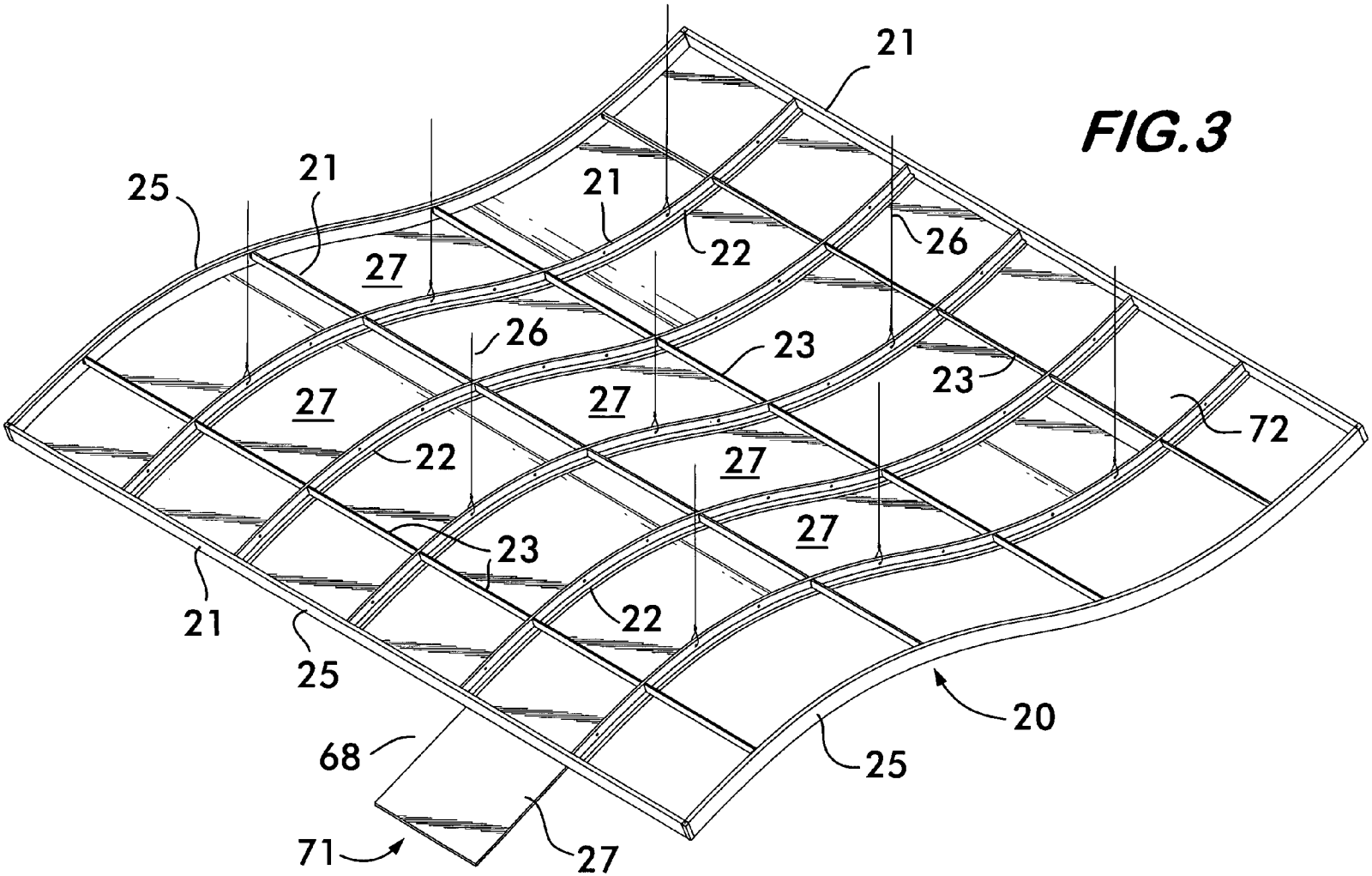
FIG. 3 is a perspective view of a suspended ceiling cloud, taken from above, showing some panels already in place in the grid of the suspended ceiling cloud, and a panel of the invention being inserted into place in the grid.

In a suspended ceiling cloud 20, as seen, for instance, in FIGS. 2 and 3, a grid 21 is formed of main beams 22 and cross beams 23, with a perimeter strip 25 extending around the outside of the suspended ceiling cloud 20. The main beams 22 and cross beams 23 are secured to the perimeter strip 25. The grid 21 is suspended from a structural ceiling by hang wires 26. Panels 27 are supported by the grid 21. The suspended ceiling cloud 20 creates a free floating, ornamental effect.

Figure 1:
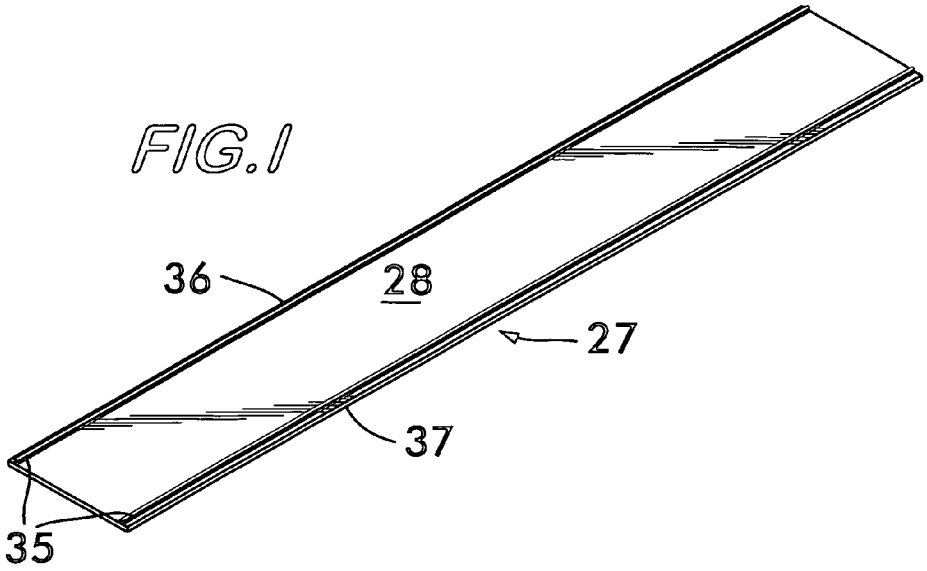
FIG. 1 is a perspective view of a length of unbent flexible sheet, having tracks fixed on the sheet, prior to being inserted into a grid, whether curved or flat, in a suspended ceiling cloud, to form a panel in the grid.

Lengths of flat, flexible sheets 28, as seen in FIG. 1, form the panels 27 in grid 21 of cloud 20.

Grids 21 may be of various forms, some of which are shown in FIG. 2. A grid 21 may be in the form of a wave 30 with a contour having longitudinally extending parallel main beams 22 bent first upward, and then downward, and then upward, as shown in FIG. 2. Such a grid 21 in the form of a wave is also shown in U.S. Pat. No. 6,374,564. Other shapes of grids 21 that form clouds 20, as seen in FIG. 2, include vaults 31 and valleys 32, and flat grids 33. Such shapes, as well as others, may be used alone to form the cloud, or they may be combined.

Lengths of flat, flexible, sheets 28 form the panels 27 in the clouds 20 of the invention. Tracks 35 that extend, and are fixed, along the longitudinal edges at 36 and 37 of the flat flexible sheets 28 that form panel 27 are secured in tracks 40 that are fixed to the bottom of the flanges 41 of longitudinally extending parallel main beams 22 in the grid 21 of the cloud 20.

There is shown in FIG. 1 a rectangular panel 27 formed from a length of flat, flexible sheet 28, in a relaxed, unbent, condition. The lengths of flat, flexible sheets 28 that form panel 27 may be of a thin gauge metal, or any other flexible material, such as a plastic. The tracks 35 extend, and are fixed, longitudinally along the edges of the lengths of flat, flexible sheets 28 that form panel 27, desirably by an adhesive 55.

Tracks 40 are also fixed on the bottom of the flanges 41 of the longitudinally extending parallel main beams 22, in a manner to be explained.

The tracks 40 fixed on the flanges 41 of the longitudinally extending parallel main beams 22, and the tracks 35 formed on the lengths of flat, flexible sheets 28 that form panels 27, are formed of a relatively rigid plastic. The plastic has a degree of flexibility that allows the tracks 40 fixed on the longitudinally extending parallel main beams 22, and the tracks 35 fixed on the lengths of flat, flexible sheets 28 that form the panel 27, to bend to engage with, and to follow, the vertical contour of the longitudinally extending parallel main beams 22, as will be explained.

As seen particularly in FIGS. 4 and 5, the tracks 40 on the parallel main beams 22 have a base 42 that has top hooks 43 that engage the opposing flanges 41 of a longitudinally extending parallel main beam 22. Bottom channels 46 extend below the base 42 and have inwardly extending hooks 47.

The tracks 40 are fixed on the bottom of opposing flanges 41 of the parallel main beams 22 by threading the hooks 43 over the top of the opposing flanges 41 and sliding the tracks 40 longitudinally along the longitudinally extending parallel main beams 22. Cross beams 23 and connections 51 extend high enough above the opposing flanges 41 on the parallel main beams 22 to provide clearance for the tracks 40 on a main beam 22 to be threaded along, and fixed on, such parallel main beam 22.

In FIGS. 4 and 5, the cross beams 23 and the connection 51 are shown in phantom. The connection 51 is desirably of a stab-in type as shown, for instance, in U.S. Pat. No. 6,305,139, for Beam Clip, incorporated herein by reference.

The tracks 35 fixed along the edges of a length of flat, flexible sheet 28 that forms panel 27 have a stepped base portion 53 that is fixed on the flat, flexible sheet 28 with adhesive 55, and a T-section 56 that extends above the base 53 from a thickened section of such base 53. The top of the T-section 56 has downwardly, relatively rigid arms 57.

A flexible side curved extension 58 extends laterally from the base 53, beyond an edge 61 of the flat, flexible sheet 28 that forms panel 27.

The tracks 35 fixed on the flat, flexible sheet 28 that forms panel 27 are shown engaged with the tracks 40 fixed on a parallel main beam 22, in the drawings. As seen in FIG. 4, the T-sections 56 of the tracks 35 on the flat, flexible sheet 28 that forms the panel 27, are captured within the channel 46 of the tracks 40 on the parallel main beam 22, in the vertical plane, while allowing the tracks 35 fixed on the flat, flexible sheet 28 that forms the panel 27, to slide within the tracks 40 fixed on the parallel main beam 22.

The tracks 40 fixed on the parallel main beam 22 remain fixed longitudinally on the main beam 22 through friction between the track 40 and the parallel main beam 22, when the tracks 35 fixed on the flat, flexible sheet 28 are threaded into the tracks 40 fixed on the parallel main beam 22 at one end of the grid 21 and then snaked along the main beam 22.

In the alternative, the tracks 35 fixed on the flat, flexible sheet 28 that forms the panel 27 can be snapped into the tracks 40 fixed on the longitudinally extending parallel main beams 22 as shown, for instance, in FIG. 5. In such operation, the flat, flexible sheet 28 is positioned below the grid 21 at its intended position in the grid 21 and simply snapped into position by applying an upward force against the bottom of the flexible sheet 28, at the edges 36 and 37 below the matching tracks 40 fixed on the main beams 22, and 35 on the flexible sheets 28.

The flexible sheets 28 can also be applied by any combination of snapping the tracks 35 into position on tracks 40, or threading the tracks 35 fixed on the flexible sheets 28 into position in the tracks 40 fixed on the main beams 22. The primary method of engaging the tracks 35 fixed on the flexible sheets that form the panels 27 and the tracks 40 fixed on the main beams 22, is by threading. There is shown in FIG. 3, a flexible panel 28 being secured in the grid 21 by threading. The panels 27 at locations 62, 63, 64, and 65, have already been threaded into a grid 21 that is vertically contoured. The length of the panels 27 at such locations have been cut to conform to the length of the contoured grid 21 so that only one length of panel 27 need be threaded between a pair of main beams 22.

When desired, multiple shorter lengths of panel 27 can be threaded successively into position between a pair of parallel main beams 22, with the ends of the panels 27 abutting one another to provide a continuous surface in grid 21.

In FIG. 3, panel 27 is shown with tracks 35 being threaded into tracks 40 in the direction of arrow 67, between a pair of main beams 22, at location 68. The panel 27 is pushed along by the installer grasping the panel 27 at its sides, or end, outside the grid 21 and applying force in the direction of the arrow 71. As seen in FIG. 3, the panel 27 is being pushed into the open space in grid 21 at location 72.

When the tracks 35 and 40 are secured together and are in place, as seen particularly in FIGS. 4 and 6, flexible side curved portions 58 along the sides of the tracks 35, fixed on the flexible sheets 28 that form panel 27, abut at the tops to provide a cosmetic closure between the panels 27 at location 59.

The colors of the panels 27, the tracks 35 and 40, the perimeter strip 25, and that on the bottom of main beams 22, can be suitably chosen to provide the desired aesthetic effect in the suspended ceiling cloud 20.

As seen in FIG. 7, the outermost panel 27 next to the perimeter strip 25 simply rests on a ledge 75 of the perimeter strip 25. Sections of the perimeter strip 25 are secured together by a fitted plate 76 that is held to the perimeter strip 25 by self-tapping screws 77 applied from outside the perimeter strip 25.

Figure 8:
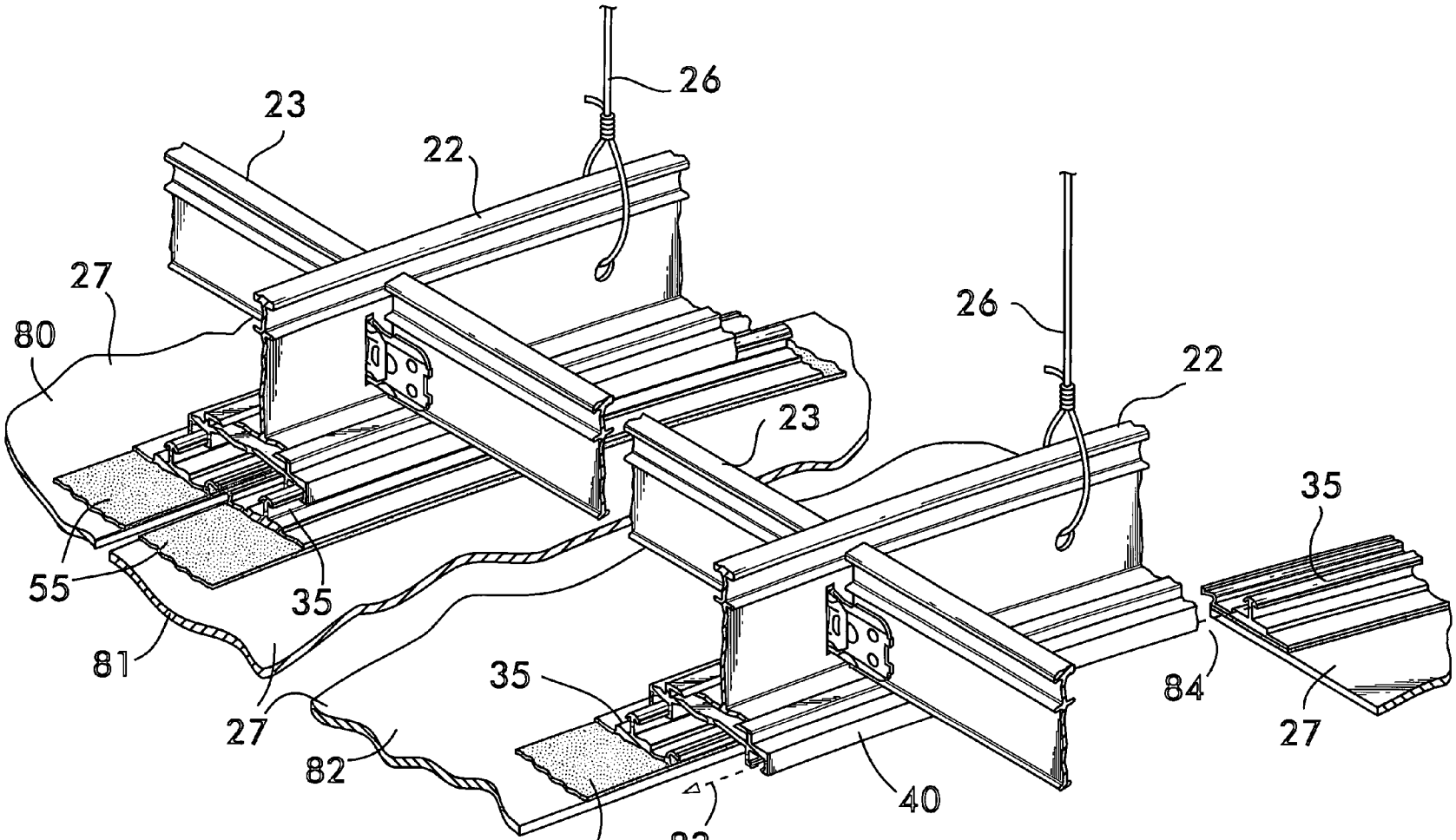
FIG. 8 is a perspective view of some flexible panels in place in the grid of a suspended ceiling cloud, with another panel about to be inserted into the grid of the cloud.

In FIG. 8, there is shown sections of panels 27 in place at locations 80, 81, and 82, with another panel 27 about to be inserted in the direction of arrow 83, at location 84, by threading.

Generally, the width between a pair of parallel main beams 22 is 24 inches and panels 27 that are slightly less than that width are used, to provide a clearance between panels 27. Such clearance is covered by the track flexible side curved sections 58 as described above.

However, panels 77 more narrow than those described above, can be used, for instance, as decorator strips, where desired. Such a more narrow panel 77 is shown in FIG. 6. The narrow panel 77 must be wide enough to provide for the insertion of a cross beam 23, along with the clearance necessary for the engagement of the tracks 35 fixed on the flexible sheet 28 and tracks 40 fixed on main beams 22. As seen in FIG. 6, track 80 fixed on main beam 22 has a base 81 that is common to both T's that are attached to the decorator strip formed by narrow panel 77.

What is claimed is:

1. In a suspended ceiling segment in the form of a cloud (20) having a grid (21) with longitudinally extending parallel main beams (22) of inverted T-cross section having flanges (41) at the bottom of a web, wherein the grid (21) supports panels;

the improvement comprising first tracks (35) of a flexible plastic, adhesively fixed on an upper side of panels (27) formed of lengths of flexible sheets (28), each of which first tracks separately engages one of second tracks of flexible plastic (40), fixed on the flanges (41) on the main beams (22).

2. The improved ceiling segment of claim 1 wherein the longitudinally extending parallel main beams (22) are curved in a vertical plane.

3. The improved ceiling segment (20) of claim 1 wherein the second tracks (40) have an inverted U shape in cross-section, and the first tracks (35) are captured in the inverted U-shape, when the first tracks (35) and second tracks (40) are engaged.

4. The improved ceiling segment of claim 1 wherein the panels reinforce the grid (21) when the first tracks (35) and second tracks (40) are engaged.

5. The improved ceiling segment of claim 1 wherein flexible side curved portions (58) along sides of the first tracks (35), fixed on the flexible sheets (28) that form panels (27), abut to provide a cosmetic closure between the panels (27).

* * * * *